US008925533B2

(12) United States Patent
Nakao et al.

(10) Patent No.: US 8,925,533 B2
(45) Date of Patent: Jan. 6, 2015

(54) IGNITION COIL FOR INTERNAL COMBUSTION ENGINE

(75) Inventors: Kengo Nakao, Kariya (JP); Kazuhide Kawai, Kariya (JP); Katsunori Akimoto, Okazaki (JP)

(73) Assignee: Denso Corporation, Kariya (JP)

( * ) Notice: Subject to any disclaimer, the term of this patent is extended or adjusted under 35 U.S.C. 154(b) by 883 days.

(21) Appl. No.: 13/154,841

(22) Filed: Jun. 7, 2011

(65) Prior Publication Data

US 2011/0297133 A1 Dec. 8, 2011

(30) Foreign Application Priority Data

Jun. 7, 2010 (JP) ..... 2010-129695
Apr. 22, 2011 (JP) ..... 2011-096431

(51) Int. Cl.

| | |
|---|---|
| ***F02P 7/02*** | (2006.01) |
| ***F02P 3/02*** | (2006.01) |
| ***H01F 38/12*** | (2006.01) |
| *F02P 13/00* | (2006.01) |
| *H01F 27/02* | (2006.01) |

(52) U.S. Cl.

CPC . *F02P 3/02* (2013.01); *H01F 38/12* (2013.01); *F02P 13/00* (2013.01); *H01F 27/02* (2013.01)
USPC ..... 123/635; 123/634

(58) Field of Classification Search

CPC . H01F 38/12; H01F 2038/122; H01F 27/022; H01F 27/04; F02P 3/02; F02P 13/00; H01T 13/44
USPC ..... 123/634, 635
See application file for complete search history.

(56) References Cited

U.S. PATENT DOCUMENTS

| | | | | |
|---|---|---|---|---|
| 6,005,464 | A * | 12/1999 | Sakamaki et al. | 336/96 |
| 6,023,215 | A * | 2/2000 | Sakamaki et al. | 336/96 |
| 6,094,121 | A * | 7/2000 | Sakamaki et al. | 336/96 |
| 6,169,471 | B1 * | 1/2001 | Sakamaki et al. | 336/96 |
| 6,227,186 | B1 * | 5/2001 | Seidl et al. | 123/634 |
| 7,487,767 | B2 * | 2/2009 | Shimada et al. | 123/634 |
| 7,673,623 | B2 * | 3/2010 | Maekawa | 123/635 |
| 8,161,955 | B2 * | 4/2012 | Anzo et al. | 123/634 |
| 2007/0235013 | A1 * | 10/2007 | Maekawa | 123/635 |
| 2008/0276918 | A1 * | 11/2008 | Skinner et al. | 123/635 |
| 2011/0247600 | A1 * | 10/2011 | Anzo et al. | 123/634 |
| 2012/0227715 | A1 * | 9/2012 | Kawai et al. | 123/634 |

FOREIGN PATENT DOCUMENTS

| | | |
|---|---|---|
| JP | A-2007-109867 | 4/2007 |
| JP | A-2007-281350 | 10/2007 |
| JP | A-2007-303401 | 11/2007 |
| JP | A-2008-60188 | 3/2008 |

* cited by examiner

*Primary Examiner* — Hai Huynh
*Assistant Examiner* — Raza Najmuddin
(74) *Attorney, Agent, or Firm* — Oliff PLC

(57) ABSTRACT

An ignition coil for the internal combustion engine has a cylinder portion and a head portion. A pillar portion that forms a part of a ventilation passage that communicates inside and outside of a plug hole via a sealing member, and a cover portion that covers the pillar portion without blockading an upper opening of a ventilation opening of the pillar portion are formed on a side of the head portion.

7 Claims, 14 Drawing Sheets

IGNITION COIL FOR INTERNAL COMBUSTION ENGINE

CROSS-REFERENCE TO RELATED APPLICATION

This application is based on and claims the benefit of priority from earlier Japanese Patent Applications No. 2010-129695 filed Jun. 7, 2010, and No. 2011-96431 filed Apr. 22, 2011, the descriptions of which are incorporated herein by reference.

TECHNICAL FIELD

The present disclosure relates to an ignition coil used for generating a spark between a pair of electrode in a spark plug for an internal combustion engine.

BACKGROUND

A fuel-air mixture is burnt in an internal combustion engine by inserting a cylindrical part of an ignition coil into a plug hole provided in the engine, and igniting a spark plug attached to a tip in an axial direction of the cylindrical part.

Moreover, ozone gas etc. due to a high voltage is generated in the plug hole. Therefore, a ventilation passage is formed to the ignition coil in order to ventilate these gases with air outside in the plug hole.

In addition, in the process of the engine that is cooled from the warm state, pressure in the plug hole becomes negative pressure by the gas in the plug hole being cooled.

At this time, if the ignition coil is flooded with water, water might enter into the plug hole from the ventilation passage.

Therefore, formation of the ventilation passage is specially designed to prevent water being flooded by arranging a sealing rubber etc. between the ignition coil and an opening of the plug hole.

For example, an ignition coil (igniter) with a well-planned ventilation passage is disposed in JP 2008-60188.

In this ignition coil, on a side of a head that is disposed outside in the plug hole, a water collecting chamber that collects the water infiltrated from the outside of the head and a ventilation passage that communicates between the water collecting chamber and the plug hole are formed.

Further, the water such as washing water may be surely prevented from infiltrating in the plug hole by collecting the water in the water collecting chamber, and the water collected in the water collecting chamber may be drained easily.

Moreover, in the ignition coil device for the internal combustion engine disclosed in JP 2007-303401, it is disclosed that a space part is formed in an upper part of a connector case, a penetration hole is formed from the space part downwardly, and a penetration opening is communicated with the plug hole by a trench.

However, in JP 2008-60188, when the water flows down along a sidewall portion of the head, the water is likely to infiltrate into a ventilating opening disposed under the water collecting chamber.

Moreover, in JP 2007-303401, the space part is formed by a cover that covers the connector case, and the ventilation of the space part is enabled by a gap formed between the cover and the connector case.

Therefore, differences might be caused in the formation of the gap, and there is a possibility that the water may be infiltrated when the gap is enlarged while enough ventilation becomes impossible when the gap is narrowed.

SUMMARY

An embodiment provides an ignition coil for internal combustion engine that can prevent water to infiltrate in a water collecting chamber, and can easily drain the water that is collected in the water collecting chamber.

In an ignition coil for internal combustion engine according to a first aspect, the ignition coil includes a cylinder portion disposed in a plug hole of the internal combustion engine by insertion, a head portion connected to the cylinder portion and disposed outside of the plug hole, and a sealing member disposed outside the cylinder portion in a radial direction and under the upper head portion for preventing water from infiltrating into the plug hole from an opening of the plug hole, wherein, a pillar portion that forms a part of a ventilation passage that communicates inside and outside of the plug hole via the sealing member and a cover portion that covers the pillar portion without blockading an upper opening of a ventilation opening of the pillar portion are formed on a side of the head portion.

The cover portion has a surrounding wall portion that covers an upper side and surroundings of the pillar portion, a bottom wall portion that closes a lower side of the surrounding wall portion, a water collecting chamber, which is a space formed by enclosing the surrounding wall portion and the bottom wall portion, that temporarily accommodate the water infiltrated from the outside of the upper head portion, and a communication hole formed in the bottom wall portion to drain the water accommodated in the water collecting chamber, and to communicate between the water collecting chamber and the outside of the plug hole.

A lower edge surface of the bottom wall portion is located above a lower edge surface of the surrounding wall portion.

In the ignition coil for the internal combustion engine of the present disclosure, atmosphere and inside the plug hole is communicated through the communication hole, the water collecting chamber, the ventilation opening, and the ventilation passages.

Moreover, the gas in the plug hole flows from the ventilation passage to the ventilation passage, the ventilation opening and the water collecting chamber, and may be exhausted from the communication hole of the water collecting chamber to the outside of the ignition coil.

By this, the ventilation of inside the plug hole and the outside may be performed.

Moreover, in the process of the engine being cooled down after the engine gets warm due to a combustion in the engine that uses the ignition coil, pressure inside the plug hole becomes negative.

At this time, when the upper head portion of the ignition coil is in the state of being wet, although the water outside of the upper head portion is infiltrated from the communication hole into the water collecting chamber, the water may be accommodated temporarily in the water collecting chamber.

Then, since the upper opening of the pillar portion opens to the water collecting chamber, the water infiltrating from the water collecting chamber to the pillar portion may be prevented.

A lower edge surface of the bottom wall portion of the cover portion is located above a lower edge surface of the surrounding wall portion.

As a result, when the upper head portion gets wet and the water flows down along the cover portion, the water entering into the communication hole may be prevented by a projected portion that projects from a lower edge side of the bottom wall portion.

Therefore, it becomes difficult for the water to infiltrate into the water collecting chamber, thus the ventilation of the gas in the plug hole influenced by the infiltration of the water may be effectively prevented.

Moreover, it becomes difficult for the water to form the water film in the communication hole by forming the projected portion, as well as the water collected in the water collecting chamber may be drained effectively.

Moreover, when the water enters into the water collecting chamber because the upper head portion is wet etc., the water may be easily drained from the communication hole when the pressure in the plug hole changes into positive or normal pressure in the process of the engine getting warm from the cooled state.

Thus, in the ignition coil of the present disclosure, the small quantity of the water is repelled by the cover portion while the large quantity of the water may be stored in the water collecting chamber and this makes it easy to drain water from the communication hole.

Therefore, according to the ignition coil for the internal combustion engine of the present embodiment, the water infiltrating into the plug hole may be prevented by collecting the water in the water collecting chamber.

In the ignition coil for internal combustion engine according to a second aspect, the communication hole is formed as a width-narrowing slit that has an opening that reduces its width from one end to another end.

In the ignition coil for internal combustion engine according to a third aspect, a drainer wall is formed downwardly on an edge of the width-narrowing slit for draining the water collected in a part where the width of the opening is narrowed.

In the ignition coil for internal combustion engine according to a fourth aspect, a baffle plate is disposed in the water collecting chamber that interrupts between the communication hole and the upper opening so as to prevent the water infiltrated from outside to infiltrate directly into the upper opening through the communication hole, and a communication space is formed between an outer side of the baffle plate and an inner side of the surrounding wall portion at the position offset from the top of the communication hole in axial direction.

In the ignition coil for internal combustion engine according to a fifth aspect, the communication hole is formed as a space between the inner side of the bottom wall portion and the outer side of the pillar portion, and the space is formed so that its width is non-uniform.

In the ignition coil for internal combustion engine according to a sixth aspect, an upper surface of the bottom wall portion is inclined downwardly toward the direction where the communication hole is formed.

DETAILED DESCRIPTION OF THE PREFERRED EMBODIMENTS

With reference to the accompanying drawings, hereinafter will be described several embodiments of the present disclosure.

(First Embodiment)

Figure 1:
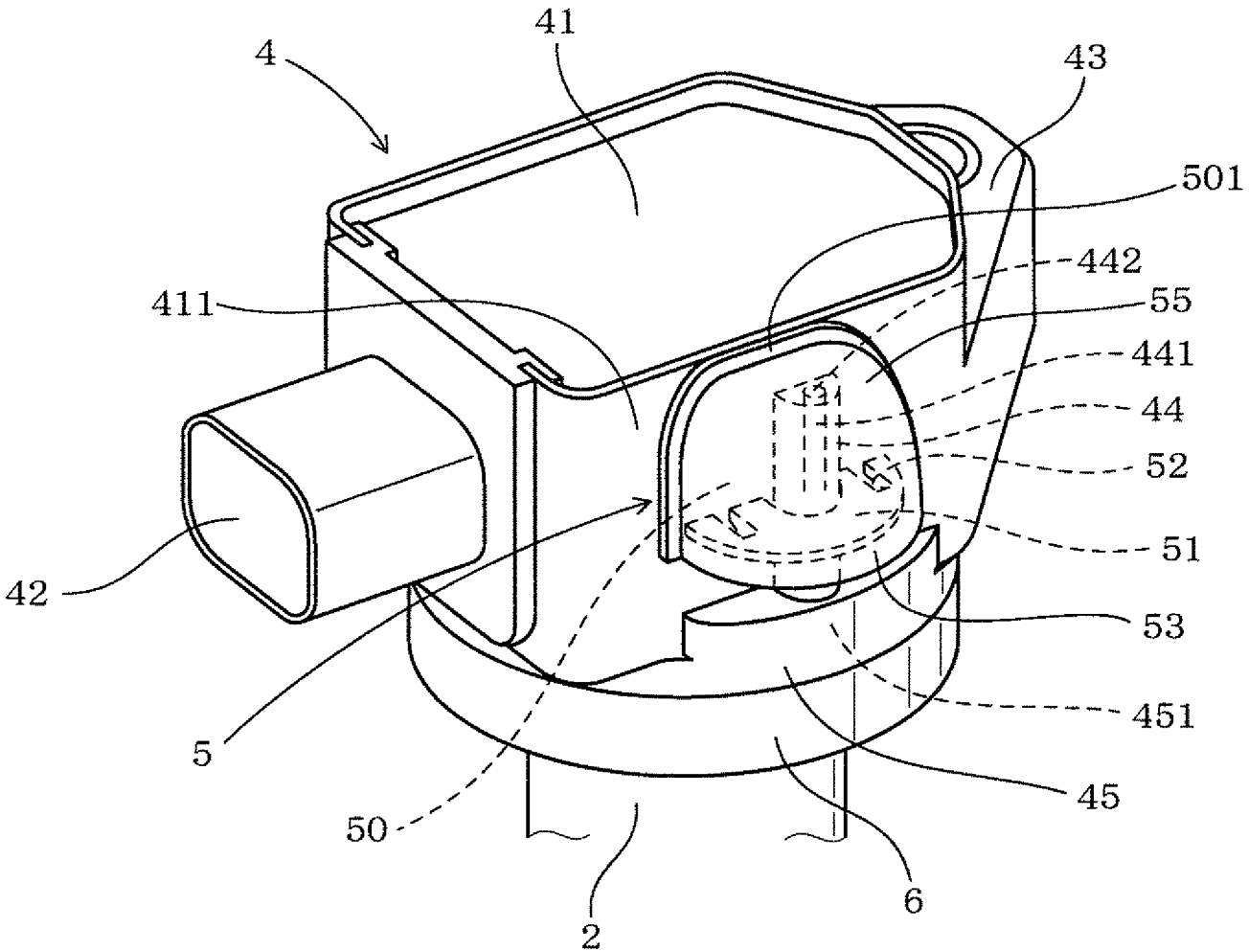
FIG. 1 shows a perspective view of an upper part of an ignition coil for an internal combustion engine in a first embodiment.
Figure 3:
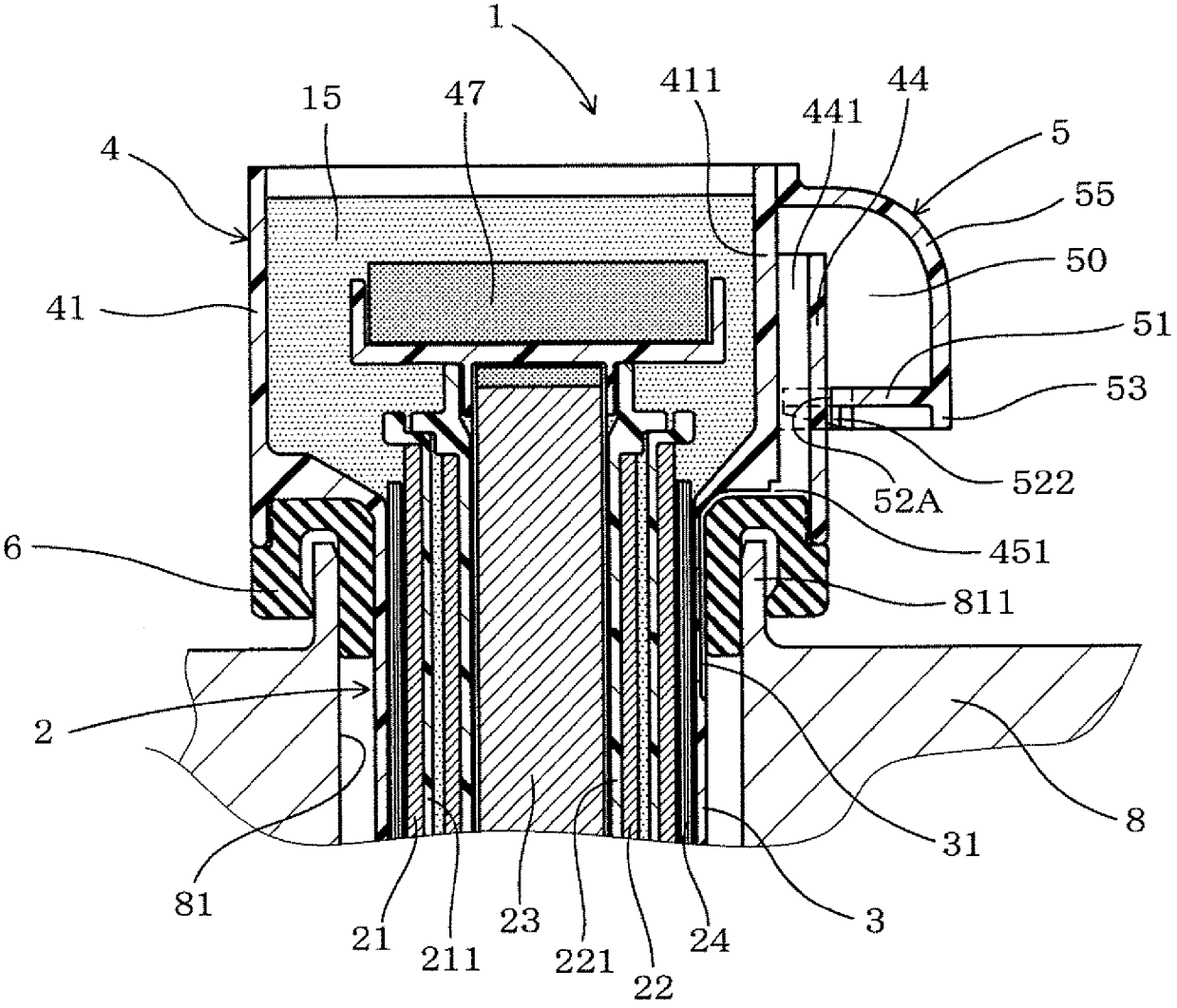
FIG. 3 is a sectional view taken along A-A line of FIG. 2 showing the upper part of the ignition coil for the internal combustion engine in the first embodiment.

An ignition coil 1 for an internal combustion engine of the present embodiment has a cylinder portion 2 and a sealing member 6, a rubber for example, as shown in FIGS. 1 and 3.

The cylinder portion 2 is disposed by insertion in a plug hole 81 of the internal combustion engine.

An upper head portion 4 is connected with the cylinder portion 2, and is disposed outside the plug hole 81.

The sealing member 6 is disposed outside the cylinder portion 2 in a radial direction and under the upper head portion 4.

The sealing member 6 prevents water infiltrating into the plug hole 81 from an opening of the plug hole 81.

A pillar portion 44 and a cover portion 5 are disposed on a side of the upper head portion 4.

The pillar portion 44 forms a part of a ventilation passage that communicates inside and outside of the plug hole 81 via the sealing member 6.

The cover portion 5 covers the pillar portion 44 without blockading an upper opening 442 of a ventilation opening 441 of the pillar portion 44.

The cover portion 5 has a surrounding wall portion 55, a bottom wall portion 51, a water collecting chamber 50 and a communication hole 52.

The surrounding wall portion 55 covers an upper side and surroundings of the pillar portion 44.

The bottom wall portion 51 closes a lower side of the surrounding wall portion 55.

The water collecting chamber 50 is a space that is formed by enclosing the surrounding wall portion 55 and the bottom wall portion 51.

The communication hole 52 is disposed at the bottom wall portion 51.

The water collecting chamber 50 is formed to temporarily accommodate the water infiltrated from the outside of the upper head portion 4.

The communication hole 52 is formed to drain the water accommodated in the water collecting chamber 50, and to communicate between the water collecting chamber 50 and the outside of the plug hole 81.

A lower edge surface of the bottom wall portion 51 is located above a lower edge surface of the surrounding wall portion 55.

A projected portion 53 that projects from a lower edge side of the bottom wall portion 51 is formed in a bottom edge part of the surrounding wall portion 55.

The projected portion 53 is formed on an entire circumference of a bottom end of the cover portion 5 excluding a sidewall portion 411 of the upper head portion.

The ignition coil 1 for the internal combustion engine of the present embodiment is explained in detail referring FIG. 1 to FIG. 14 hereafter.

As shown in FIGS. 1 and 3, the ignition coil 1 of the present embodiment has a stick type configuration.

The ignition coil 1 forms a cylinder portion 2 by accommodating a primary coil 21 and a secondary coil 22 disposed coaxially, and the upper head portion 4 is connected to an upper part in an axial direction of the cylinder portion 2.

The ignition coil 1 may be a rectangular type, and the primary coil 21 and the secondary coil 22 may be accommodated in the upper head portion 4.

Moreover, the ignition coil 1 is operated by installing its cylinder portion 2 to a spark plug (not shown) attached in the plug hole 81 of a cylinder head of an engine 8.

As shown in FIG. 3, the cylinder portion 2 is formed by arranging the primary coil 21 and the secondary coil 22 inside and outside coaxially in a lower head portion 3.

The primary coil 21 is formed by winding an insulation-coated primary wire around an outer surface of a primary spool 211 made of a thermoplastic resin with an annular section.

The secondary coil 22 is formed by winding an insulation-coated secondary wire around an outer surface of a secondary spool 221 made of a thermoplastic resin with an annular section.

Moreover, the secondary winding has a smaller diameter than the primary winding, and the secondary winding has more numbers of turns than the primary winding to the second spool 221.

A rod-shaped center core 23 made of a magnetic material is disposed on an inner surface side of the primary coil 21 and the secondary coil 22.

A cylindrical outer core 24 made of the magnetic material is disposed on an outer surface side of the primary coil 21 and the secondary coil 22.

Moreover, the secondary coil 22 is inserted into the inner surface side of the primary coil 21, and the center core 23 is inserted into the inner surface side of the secondary coil 22 in the present embodiment.

In addition, the center core 23, the secondary coil 22, the primary coil 21 and the outer core 24 are accommodated in the lower head portion 3.

The upper head portion 4 of the present embodiment is formed unitarily by resin, and is extended from the lower head portion 3.

As shown in FIG. 3, an igniter 47 is disposed in the upper head portion 4. The igniter 47 is equipped with a switching circuit etc. that connects and disconnects the current to the primary coil 21.

The upper head portion 4 of the present embodiment is provided with a connector joint 42 that electricity connects the ignition coil 1 to a ECU (electronic controlled unit) etc., and a flange part 43 that attaches the ignition coil to the engine 8 for a main case body 41 that accommodate the igniter 47 etc.

The sealing member 6 that prevents water infiltrating into the plug hole 81 is attached to an opening 811 of the plug hole 81 of the engine 8 at a lower part of the head portion 4 (main case body 41).

As shown in FIGS. 1, 2, 3 and 6, the pillar portion 44 of the present embodiment is formed as a part that projects in a radial direction of the ignition coil 1 at an outside of the sidewall portion 411 of the main case body 41.

The pillar portion 44 is formed as a substantially hemicycle column part.

A ventilation passage formation part 45 formed by inflating a part of the main case body 41 to the side is disposed under the pillar portion 44 in a lower part of the main case body 41.

A ventilation opening 441 of the pillar portion 44 communicates to a ventilation passage 451 formed between the ventilation passage formation part 45 and the sealing member 6.

Moreover, a ventilation passage 31 for communicating the ventilation passage 451 and the plug hole 81 is formed continuously at an outer surface part of the lower head portion 3 and at an end in an axial direction of the upper head portion 4.

Figure 6:
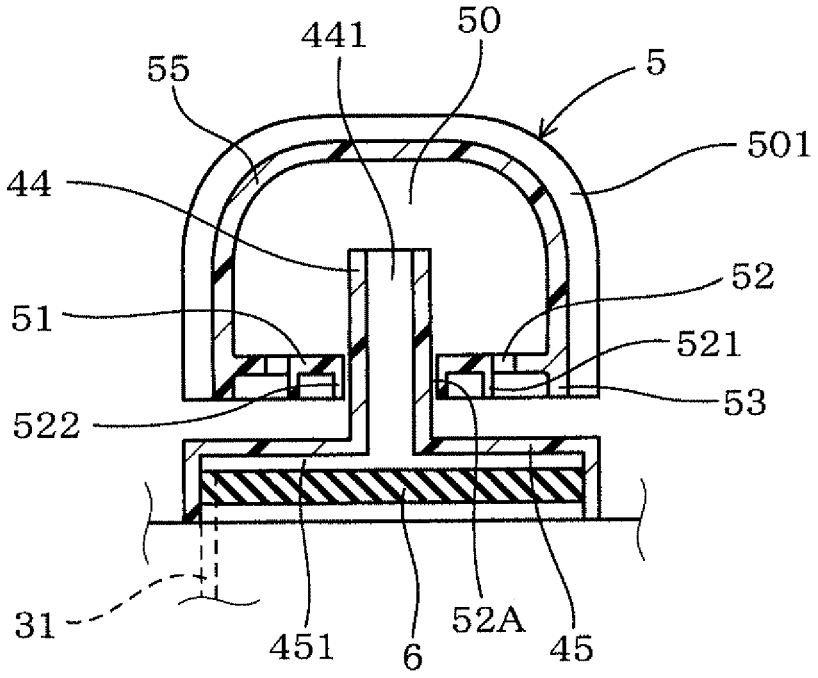
FIG. 6 is a sectional view taken along B-B line of FIG. 2 showing a vicinity of the cover portion in the first embodiment.

As shown in FIG. 6, a position where the ventilation passage 31 is formed may be positioned sifted in a circumferential direction relative to a position where the ventilation opening 441 communicates to the ventilation passage 451.

Figure 8:
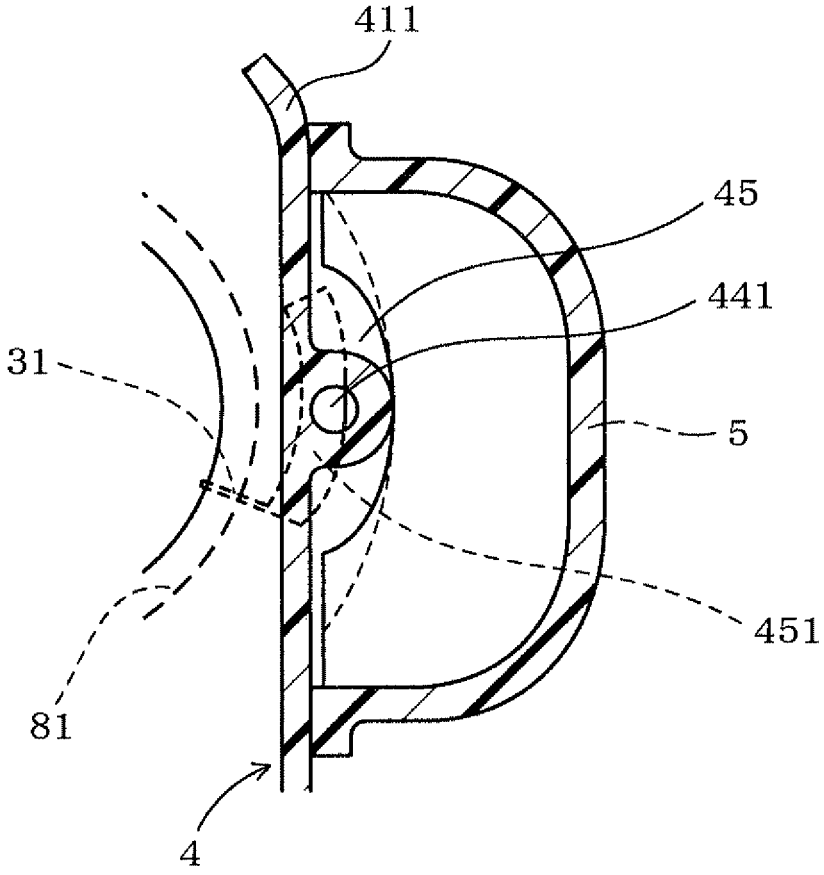
FIG. 8 is a plan view that shows a state of communication from a ventilating opening to a plug hole in the first embodiment.

Moreover, the ventilation passage 451 that connects the ventilation opening 441 and the ventilation passage 31 in a plane view is shown in FIG. 8.

The ventilation opening 441 communicates with the plug hole 81 via the ventilation passage 451 and the ventilation passage 31.

In FIG. 3, positions in a circumferential direction of the ventilation opening 441 and the ventilation passage 451 are matched in order to simplify showing in the figure.

The ventilation passage 31 is made of a groove formed continuously in an axial direction of the lower head portion 3 and in a radial direction of the upper head portion 4.

Moreover, the ventilation passage 31 may be formed to the sealing member 6.

Figure 2:
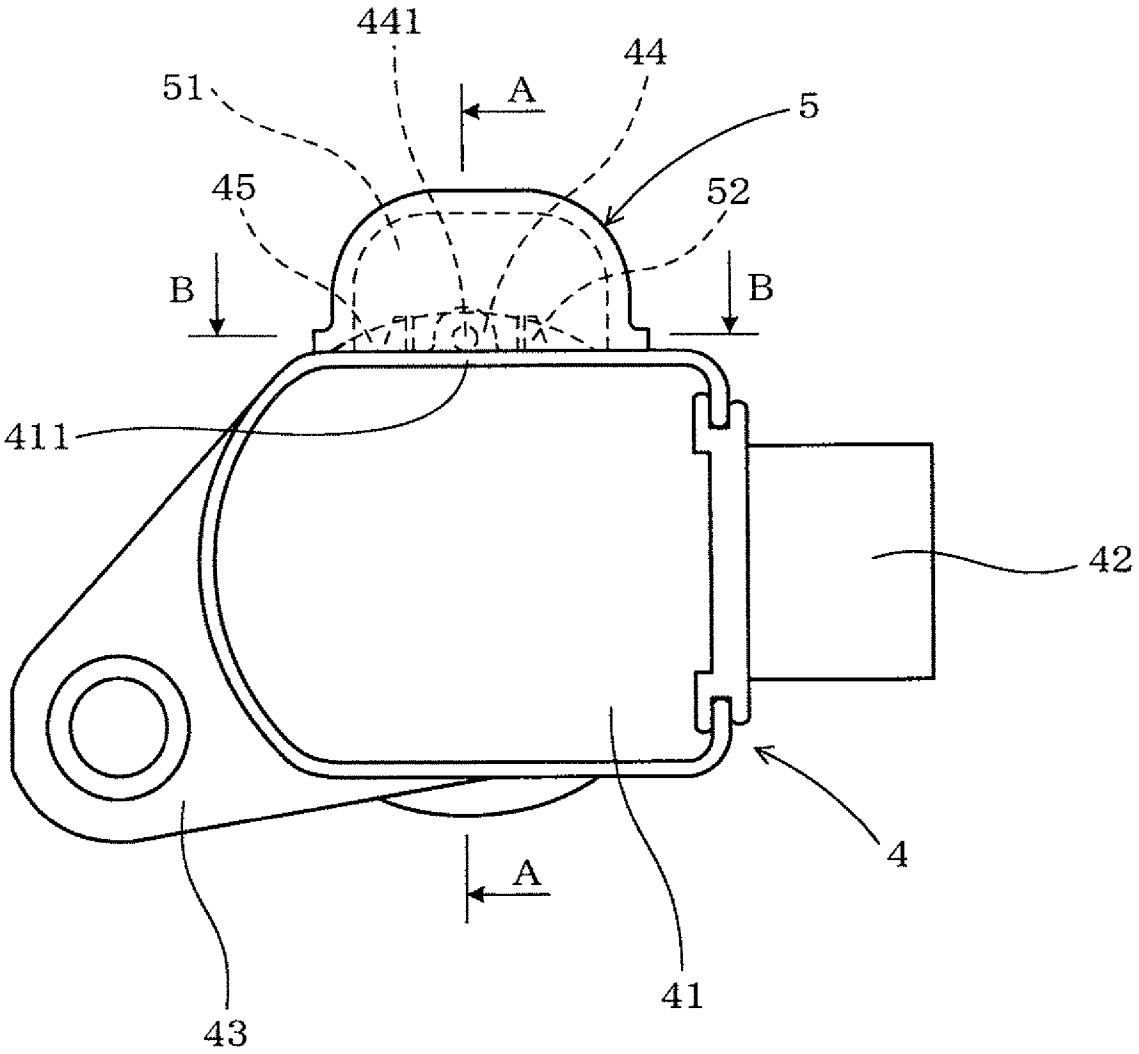
FIG. 2 shows a plan view of the upper part of the ignition coil for the internal combustion engine seen from top in the first embodiment.

As shown in FIGS. 1 and 2, after the resin molding is performed, the cover portion 5 of the present embodiment is welded by a ultrasonic wave welding to the sidewall portion 411 of the main case body 41 of the upper head portion 4.

The cover portion 5 is disposed on an outer surface of the main case body 41 at a position different from the position where the connector joint 42 and the flange part 43 are disposed.

The cover portion 5 is formed so as to cover an upper side part of the pillar portion 44 to cover a top end of the ventilation opening 441 of the pillar portion 44.

The cover portion 5 may be disposed on the sidewall portion 411 of the main case body 41 by bonding, etc.

Figure 4:
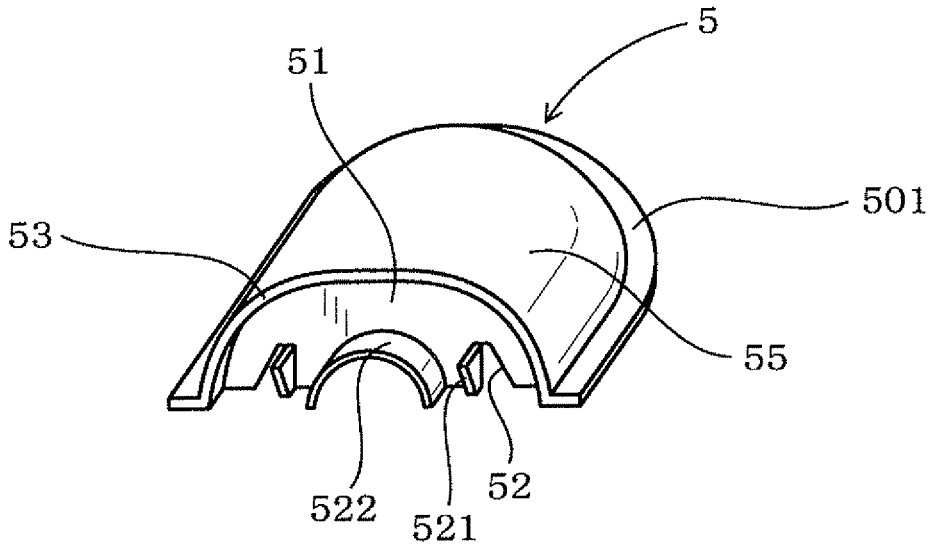
FIG. 4 shows a perspective view of a cover portion seen from bottom in the first embodiment.

Moreover, as shown in FIG. 4, an upper side and a side of the cover portion 5 are formed in a curved surface, and a flat plate-like bottom wall portion 51 is disposed at a bottom.

A flange part 501 for welding is formed to edge parts of the upper side and the side of the cover portion 5.

Further, as shown in FIG. 1, the cover portion is disposed on the main case body 41 by welding its flange part 501 to the sidewall portion 411 of the main case body 41.

As shown in FIG. 6, the bottom wall portion 51 of the present embodiment is disposed at a middle position in the vertical direction of the pillar portion 44.

The projected portion 53 of the present embodiment is disposed as a part that projects from the bottom wall portion 51 to a lower side by disposing the bottom wall portion 51 slightly above a lower edge of a side portion of the cover portion 5.

Figure 7:
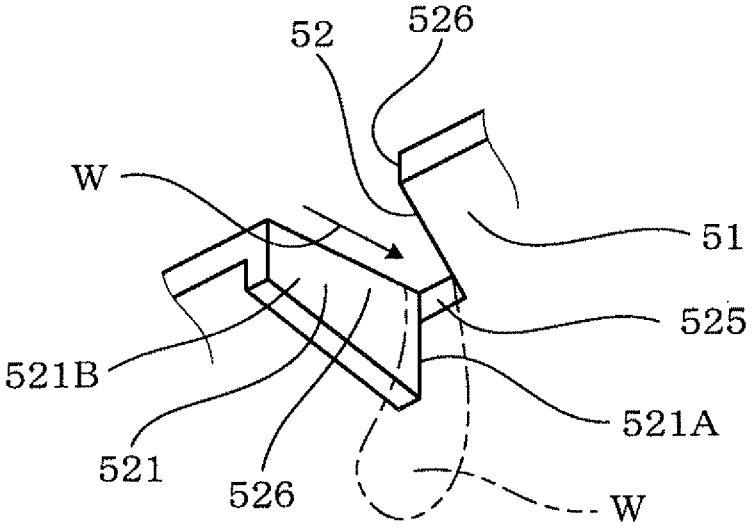
FIG. 7 shows a perspective view of a vicinity of a width-narrowing slit seen from the bottom in the first embodiment.

As shown in FIGS. 4 and 7, the communication hole 52 of the present embodiment is formed as a width-narrowing slit 52 that has an opening that reduces its width from one end to another end at the bottom wall portion 51 of the cover portion 5.

The width-narrowing slit 52 is formed on both sides of the pillar portion 44.

In the width-narrowing slit 52, a side where the width is broadened is located on an edge side of the bottom wall portion 51.

Moreover, the width-narrowing slit 52 is formed at an edge of the sidewall portion 411 of the upper head portion 4 in the bottom wall portion 51.

Effects of forming the width-narrowing slit 52 to the bottom wall portion 51 may be explained as follows.

Supposing a square through hole is formed in the bottom wall portion 51, water W that is gathered in the through hole will remain in the through hole because a surface tension that acts on the water W from all sidewalls of the through hole balances.

On the contrary, when the square through hole is formed to a slit-shape whose one of the sidewalls is opened, the surface tension will not act on the water W from the opened portion, thus the balance of the surface tension acting on the water W will be disrupted.

Further, the water W will be pulled to an opened side and an opposite side by the surface tension.

Especially in the present embodiment, as shown in FIG. 7, the water W is drawn to a narrowed-side wall 525 located on a position opposite to an opened side by the width-narrowing slit 52 whose width narrows.

As a result, a water film becomes difficult to occur in the width-narrowing slit 52, and the water W in the water collecting chamber 50 (water collected at the bottom wall portion 51) may be easily drained.

Figure 5:
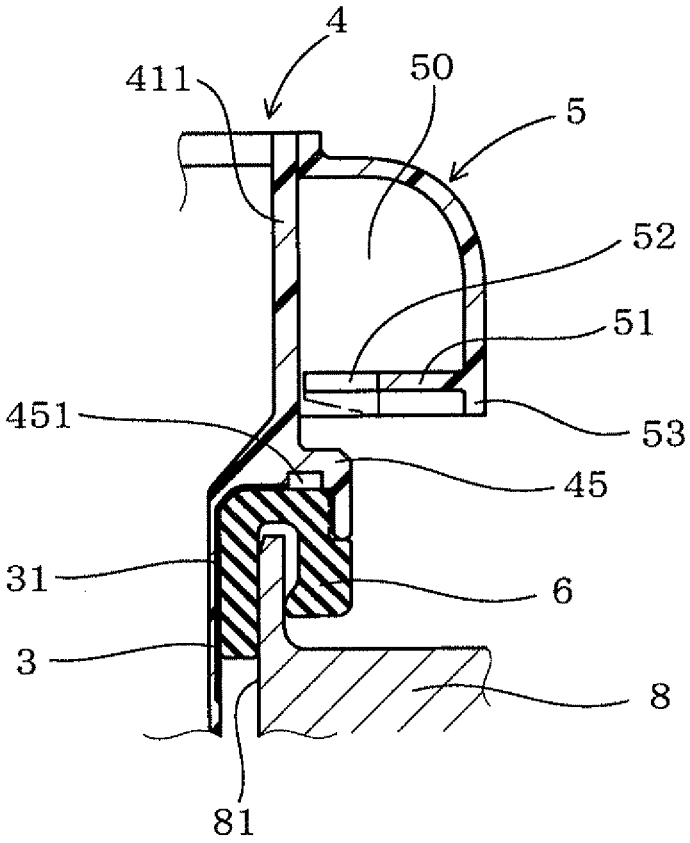
FIG. 5 is a sectional view showing a vicinity of a communication hole in the cover portion seen from the same direction as FIG. 3 in the first embodiment.

As shown in FIG. 5, the width-narrowing slit 52 is formed by cutting from an edge surface in an inner surface side of the bottom wall portion 51.

Moreover, as shown in FIGS. 3 and 6, a slight space 52A is formed between the bottom wall portion 51 of the cover portion 5 and the pillar portion 44.

A guard portion 522 that projects downwardly is formed in surroundings of the pillar portion 44 on the bottom wall portion 51 of the cover portion 5 in order to make it difficult for the water W to infiltrate into the water collecting chamber 50 from the space 52A.

The guard portion 522 is formed accompanying the formation of the space 52A.

When the space 52A is not formed between the bottom wall portion 51 and the pillar portion 44, the guard portion 522 will not be formed.

Moreover, as shown in FIG. 7, a drainer wall 521 is formed downwardly on an edge of the width-narrowing slit 52. The drainer wall 521 drains the water W collected in the narrowed-side wall 525 that is a part where the width of the opening is narrowed.

The drainer wall 521 is disposed on one side of the sidewall portion sides 526 in the width-narrowing slit 52.

The drainer wall 521 is disposed as a tapered wall where the amount of a projection increases toward the side where the width is narrowing.

Moreover, effects of disposing the drainer wall 521 in the width-narrowing slit 52 may be explained as follows.

Figure 9:
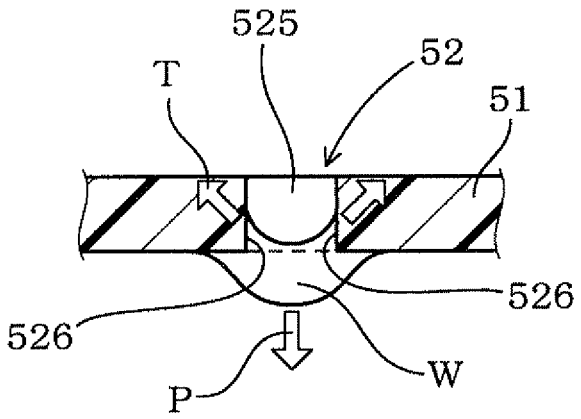
FIG. 9 is a sectional view showing the width-narrowing slit when a drainer wall is not formed in the first embodiment.

A sectional view showing a vicinity of the narrowed-side wall 525 of the width-narrowing slit 52 when the drainer wall 521 is not formed is shown in FIG. 9.

As shown in FIG. 9, it is assumed that a small quantity of water W remains near the narrowed-side wall 525 of the width-narrowing slit 52 because a sum of the surface tension T that acts on the water W from right and left sidewall portion sides 526 and a gravity P that acts on the water W are balanced in a vertical direction.

Figure 10:
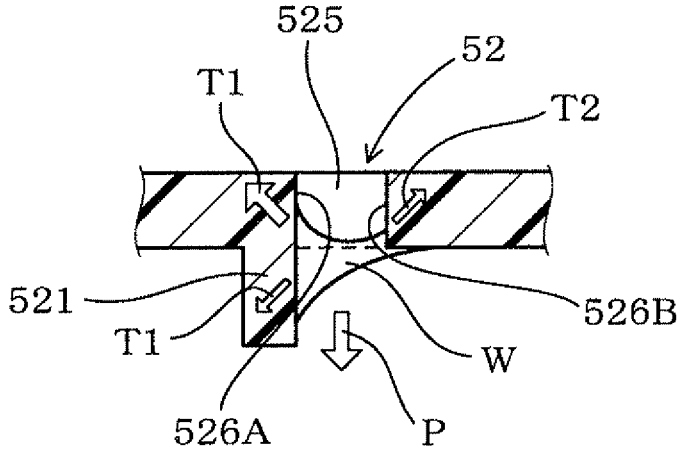
FIG. 10 is a sectional view showing the width-narrowing slit when the drainer wall is formed in the first embodiment.

A sectional view showing a vicinity of the narrowed-side wall 525 of the width-narrowing slit 52 when the drainer wall 521 is formed is shown in FIG. 10.

In this case, in FIG. 9, the surface tension T1 that acts on the water W from the sidewall portion side 526A where drainer wall 521 is formed becomes larger than the surface tension T2 that acts on the water W from the sidewall portion side 526B where drainer wall 521 is not formed.

As a result, in the balance in the vertical direction, the gravity P that acts on the water W becomes larger compared with the sum of the surface tensions T1 and T2 that acts on the water W from the both right and left sidewall portion sides 526A and 526B.

Therefore, the water W that remained on the narrowed-side wall 525 of the width-narrowing slit 52 may flow down in the vertical direction along the drainer wall 521.

Moreover, it becomes difficult for water W to infiltrate into the width-narrowing slit 52 from an oblique lower part via the drainer wall 521.

A reason for disposing the drainer wall 521 only in one side of the sidewall portion side 526A in the present embodiment is to disrupt the balance of the surface tensions T1 and T2 that act on the water W from the both right and left sidewall portion sides 526A and 526B.

Therefore, the drainer wall 521 may be assumed to be various structures that can disrupt the balance of the surface tension acting on the water W from a certain direction.

A capacity of the water collecting chamber 50 of the present embodiment is formed to the capacity more than an amount of a shrinking volume of a gas generated when the gas in the plug hole 81 is cooled and becomes negative pressure in the plug hole 81.

By this, the water sucked from the communication hole 52 at the time of negative pressure in the plug hole 81 may be prevented from reaching a top end of the ventilation opening 441 via the water collecting chamber 50.

Moreover, although not shown, the spark plug is disposed at the bottom of the plug hole 81, and the ignition coil 1 of the present embodiment has the plug attaching part for attaching the spark plug to a bottom end in an axial direction of the lower head portion 3

The plug attaching part has a rubber made plug cap where an insulator portion of the spark plug is inserted, a high voltage terminal that is conducted with an end portion of a high voltage winding of the secondary coil 22, and a coil spring that is conducted with the high voltage terminal.

A bottom end side in an axial direction of the coil spring is conducted with a terminal part formed at a tip of the insulator of the spark plug.

Moreover, as shown in FIG. 3, a filler resin 15 is filled in a space in the ignition coil 1 enclosed by the lower head portion 3 and the upper head portion 4, etc.

The filler resin 15 of the present embodiment is an epoxy resin as a thermosetting resin.

Further, after each part of the ignition coil 1 is assembled, the space in the ignition coil 1 is depressurized to produce a vacuumed space. The filler resin 15, a liquid epoxy resin, of the ignition coil 1 is then filled into the vacuumed space and hardened.

When an electric current is flown to the primary coil 21 according to a pulsed spark generation signal from the ECU, a magnetic field that passes a center core 23 and an outer core 24 is formed in the above-mentioned ignition coil 1.

Next, when the electric current flown to the primary coil 21 is intercepted, an inducement magnetic field that passes the center core 23 and the outer core 24 to the direction opposite to the magnetic field.

Further, by the formation of the inducement magnetic field, a high voltage induced electromotive force (counter electromotive force) is generated, thus a spark is generated between a pair of electrodes in the spark plug attached to the ignition coil 1.

In the ignition coil 1 for the internal combustion engine of the present embodiment, atmosphere and inside the plug hole 81 is communicated through the communication hole 52, the water collecting chamber 50, the ventilation opening 441, and the ventilation passages 31 and 451.

Moreover, the gas in the plug hole 81 flows from the ventilation passage 31 to the ventilation passage 451, the ventilation opening 441 and the water collecting chamber 50, and may be exhausted from the communication hole 52 of the water collecting chamber 50 to the outside of the ignition coil 1.

As a result, the ventilation of inside the plug hole 81 and the outside may be performed.

Moreover, in the process of the engine 8 being cooled down after the engine 8 gets warm due to a combustion in the engine 8 that uses the ignition coil 1, pressure inside the plug hole 81 becomes negative.

At this time, when the upper head portion 4 of the ignition coil 1 is in the state of being wet, although the water outside of the upper head portion 4 is infiltrated from the communication hole 52 into the water collecting chamber 50, the water may be accommodated temporarily in the water collecting chamber 50.

Then, since the upper opening 442 of the ventilation opening 441 opens to the water collecting chamber 50, the water may be prevented from infiltrating from the water collecting chamber 50 to the ventilation opening 441.

Moreover, the projected portion 53 is formed projecting downwardly on the entire circumference of the bottom end of the cover portion 5 excluding the sidewall portion 411 of the upper head portion.

As a result, when the upper head portion 4 gets wet and the water flows down along the cover portion 5, the water entering into the communication hole 52 may be prevented by the projected portion 53.

Therefore, it becomes difficult for the water to infiltrate into the water collecting chamber 50, thus the ventilation of the gas in the plug hole 81 influenced by the infiltration of the water may be effectively prevented.

Moreover, it becomes difficult for the water to form the water film in the communication hole 52 by forming the projected portion 53, as well as the water collected in the water collecting chamber 50 may be drained effectively.

Moreover, when the water enters into the water collecting chamber 50 because the upper head portion 4 is wet etc., the water may be easily drained from the communication hole 52 when the pressure in the plug hole 81 changes into positive or normal pressure in the process of the engine 8 getting warm from the cooled state.

Further, when a small quantity of water W adheres to the width-narrowing slit 52 as shown in FIG. 7, this water W may be moved to a side where the width narrows by the surface tension caused at the width-narrowing slit 52.

Then, the water W that has moved to the narrowed-side wall 525 that is a part where the width is narrowed may flow down along the drainer wall 521.

As a result, the water W that is adhered to the width-narrowing slit 52 is promptly flown down, and an existence of the water W that influences the ventilation may be prevented.

When a small quantity of the water W remains near the narrowed-side wall 525, the water W flows down from a side end portion 521A near the narrowed-side wall 525 in the drainer wall 521.

On the other hand, when the quantity of water W is large, the water W might flow down along a substantially whole side 521B of the drainer wall 521.

Thus, in the ignition coil 1 of the present embodiment, the small quantity of the water is repelled by the cover portion 5 while the large quantity of the water may be stored in the water collecting chamber 50 and makes easy to drain from the communication hole 52.

In addition, in the ignition coil 1 of the present embodiment, when a vicinity of the pillar portion 44 where the ventilation opening 441 is disposed gets wet, a splashing water from above or side is obstructed by the cover portion 5 so as not to infiltrate into the top end of the ventilation opening 441, and a splashing water from below is obstructed by the bottom wall portion 51 so as not to infiltrate into the top end of the ventilation opening 441.

Moreover, the water may be infiltrated from the communication hole 52 (slit) to the water collecting chamber 50 according to the amount, the direction, and the flow velocity of the water.

In such a case, the water is stored in the water collecting chamber 50, and it may be possible to drain the water from the water collecting chamber 50 easily through the slit 52.

Therefore, according to the ignition coil 1 for the internal combustion engine of the present embodiment, the water infiltration into the plug hole 81 may be prevented by collecting the water in the water collecting chamber 50.

Moreover, it becomes difficult for the water to infiltrate into the water collecting chamber 50, and the water collected in the water collecting chamber 50 may be easily drained.

In the present embodiment, a ventilation drain structure having the above-mentioned pillar portion 44 and the cover portion 5 is explained regarding the stick type ignition coil 1 that forms the cylinder portion 2 where the primary coil 21 and the secondary coil 22 are inserted and disposed in the plug hole 81.

It should be appreciated that the ventilation drain structure may be adopted for ignition coil 1 of a rectangular type to accommodate the primary coil 21 and the secondary coil 22 in the upper head portion 4.

The width-narrowing slit 52 as the communication hole may be the following various structures.

Figure 11:
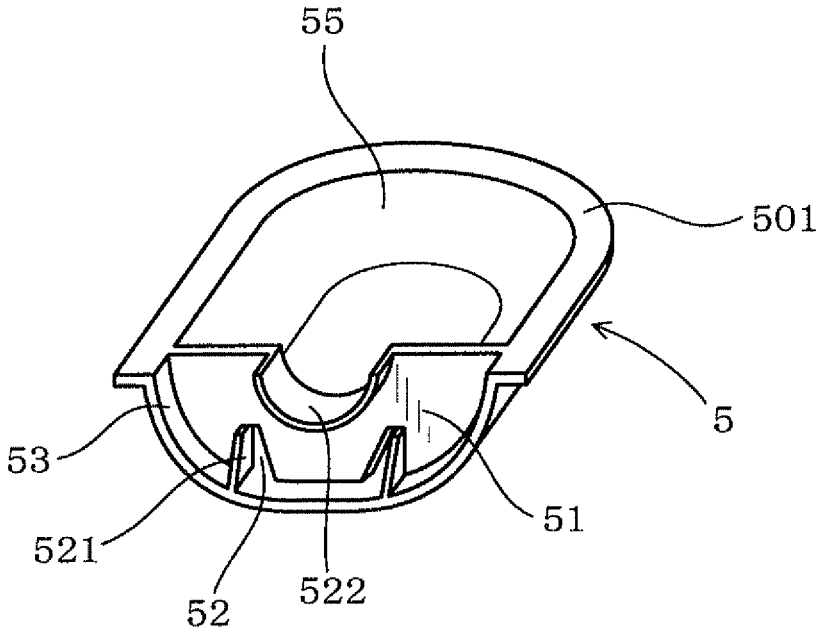
FIG. 11 shows a perspective view where the width-narrowing slit is formed on a projected portion side in the cover portion in the first embodiment.

As shown in FIG. 11, the width-narrowing slit 52 may be formed on the projected portion 53 sides in the cover portion 5.

In this case, the width-narrowing slit 52 is formed adjacent to a main cover body (surrounding wall portion) 55, and the drainer wall 521 may be formed by connecting it to the projected portion 53.

Figure 12:
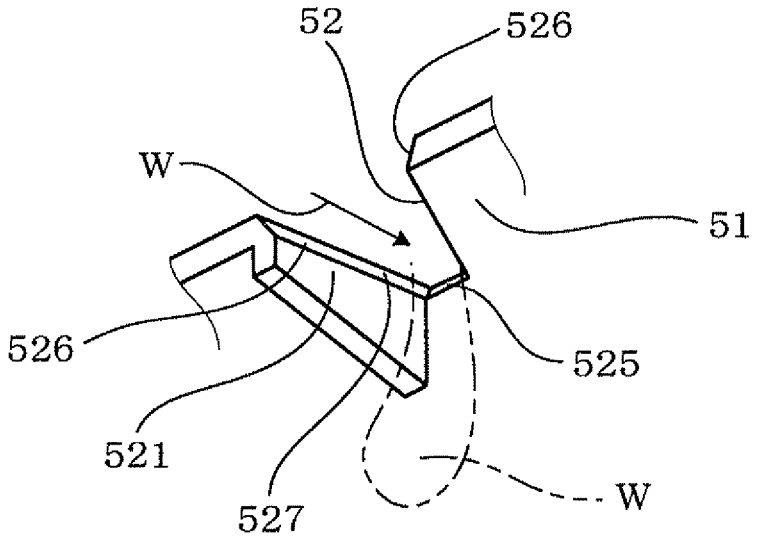
FIG. 12 shows a perspective view of a vicinity of another width-narrowing slit seen from the bottom in the first embodiment.

Moreover, as shown in FIG. 12, tapered chamfering parts 527 may be formed in top corner parts of the right and left sidewall portion sides 526 and a top corner part of the narrowed-side wall 525 in the width-narrowing slit 52.

In this case, the water W on the bottom wall portion 51 may become easy to collect in the width-narrowing slit 52 by forming the chamfering parts 527.

Figure 13:
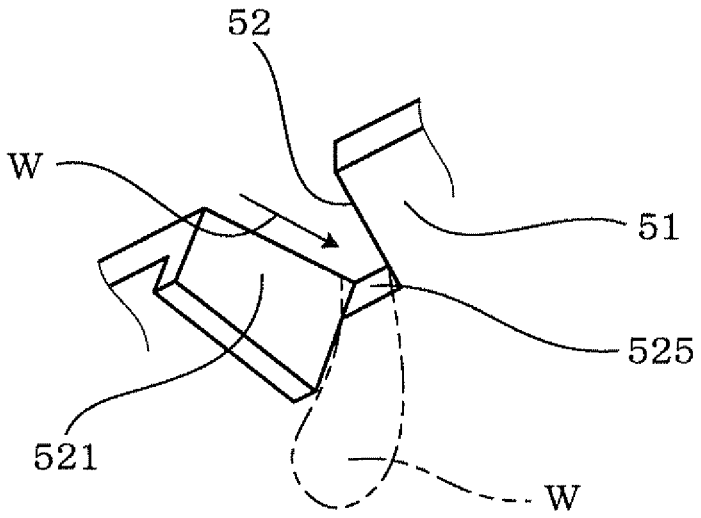
FIG. 13 shows a perspective view of a vicinity of another width-narrowing slit seen from the bottom in the first embodiment.

Moreover, as shown in FIG. 13, the drainer wall 521 may be formed not only vertically to the bottom wall portion 51 but diagonally to the bottom wall portion 51.

The drainer wall 521 may be inclined so as to form an acute angle corner part between the drainer wall 521 and the bottom wall portion 51.

In this case, the water W may become further easier to be drawn to the drainer wall 521 side by the surface tension.

Figure 14:
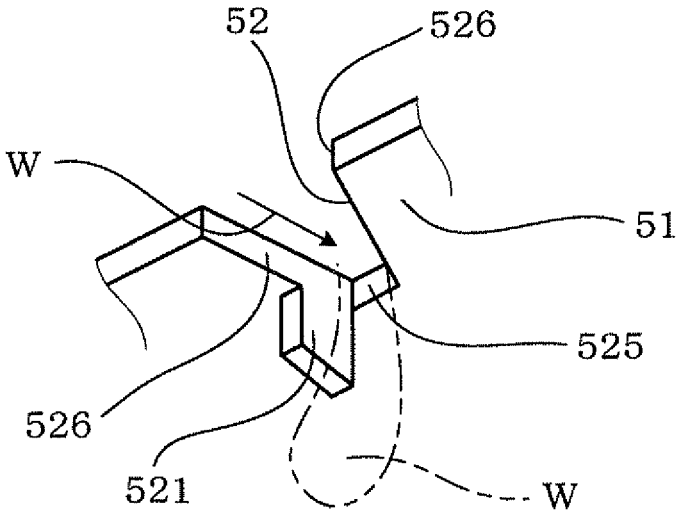
FIG. 14 shows a perspective view of a vicinity of another width-narrowing slit seen from the bottom in the first embodiment.

Moreover, as shown in FIG. 14, the drainer wall 521 may be formed only in a near part of the narrowed-side wall 525 on one of the sidewall portion sides 526 other than forming entirely on one of the sidewall portion side 526 in the width-narrowing slit 52.

(Second Embodiment)

The second embodiment shows an example regarding the ignition coil 1 whose composition of the cover portion 5 and inside the cover portion 5 is different from the above-mentioned first embodiment.

Figure 15:
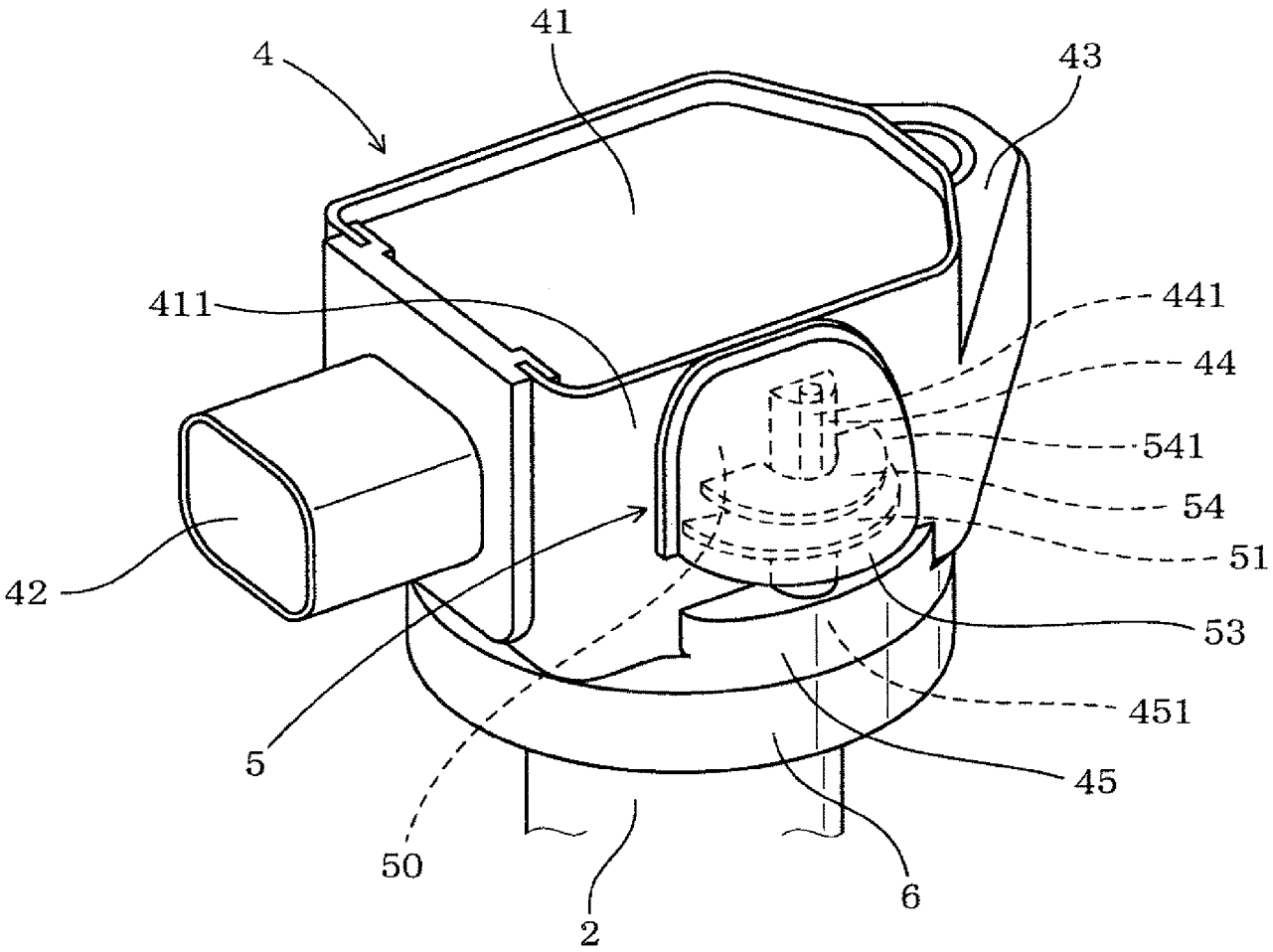
FIG. 15 shows a perspective view of an upper part of an ignition coil for an internal combustion engine in a second embodiment.
Figure 16:
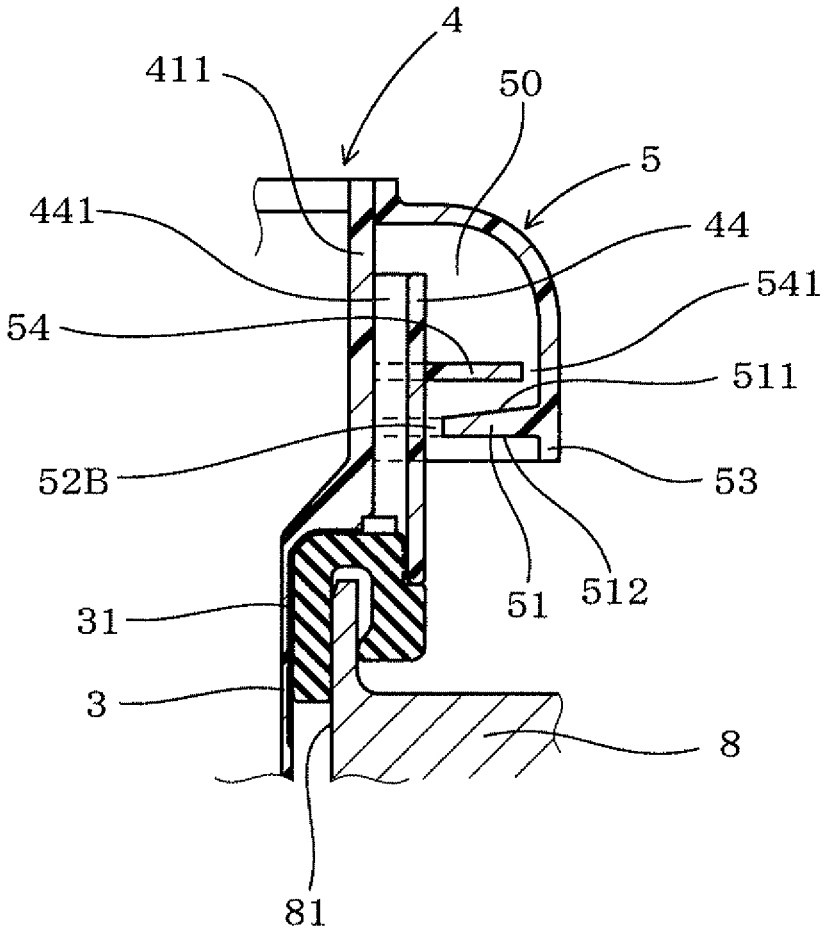
FIG. 16 is a sectional view showing the upper part of the ignition coil for the internal combustion engine in the second embodiment corresponding to the view taken along A-A line of FIG. 2.
Figure 17:
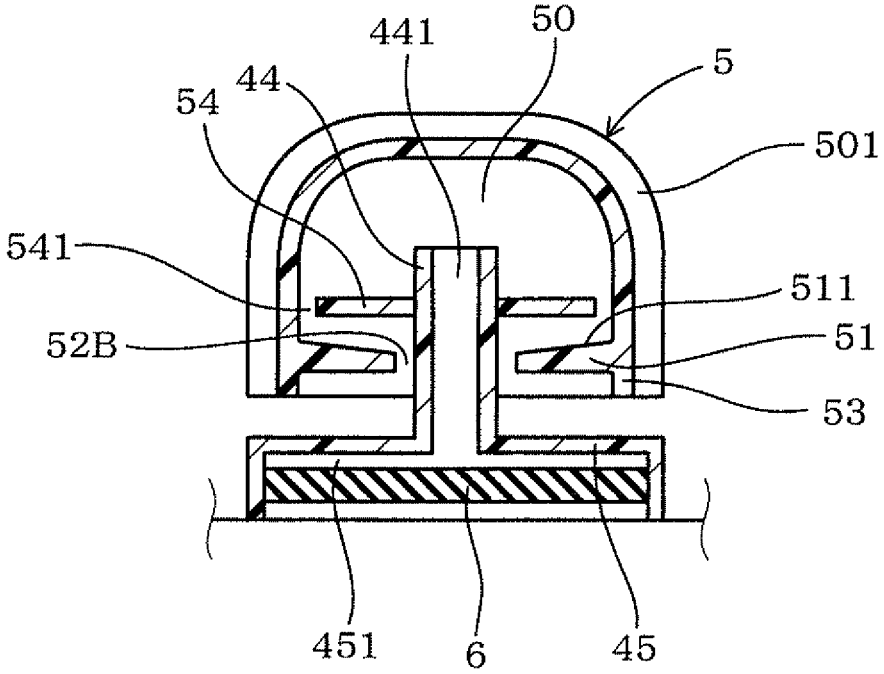
FIG. 17 is a sectional view showing a vicinity of the cover portion in the second embodiment corresponding to the view taken along B-B line of FIG. 2.

As shown in FIGS. 15, 16, and 17, a baffle plate 54 is disposed in the water collecting chamber 50. The baffle plate 54 interrupts between the communication hole 52B and the upper opening 442 so as to prevent the water infiltrated from outside from infiltrating directly into the upper opening 442 of the ventilation opening 441 through the communication hole 52B.

The baffle plate 54 is disposed so as to cover the upper side of the communication hole 52B at the upper position of the bottom wall portion 51 in the cover portion 5.

A labyrinthine structure from the communication hole 52B to the top of the ventilation opening 441 may be formed with the baffle plate 54, and the water infiltrating in the plug hole 81 may be prevented more effectively.

Moreover, an upper surface 511 of the bottom wall portion 51 in the cover portion 5 is inclined downwardly toward the direction where the communication hole 52B is formed.

The communication hole 52B of the present embodiment is formed as a space 52B around the pillar portion 44 at the bottom wall portion 51 of the cover portion 5.

Only the upper surface 511 of the bottom wall portion 51 is inclined, while a lower surface 512 is formed vertically to the main cover body 55.

Figure 19:
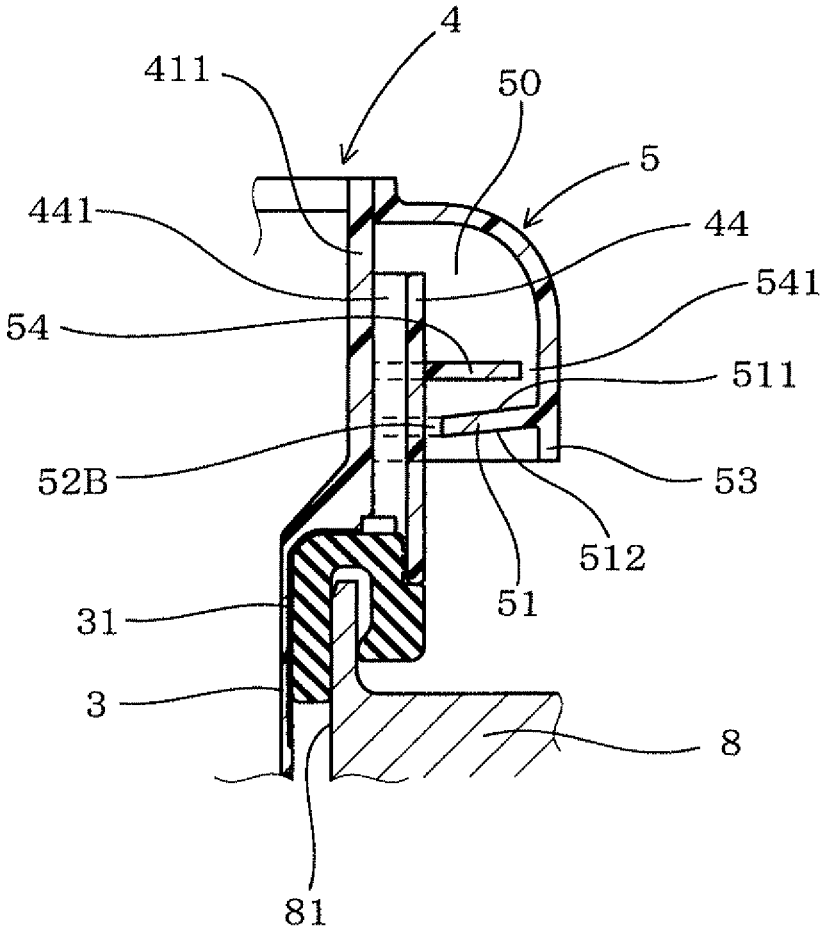
FIG. 19 is a sectional view showing a modification of a bottom wall portion in the second embodiment corresponding to the view taken along A-A line of FIG. 2.

On the other hand, as shown in FIG. 19, the bottom wall portion 51 may be formed by inclining the entire portion (upper surface 511 and lower surface 512).

Moreover, as shown in FIGS. 16 and 17, the baffle plate 54 is disposed around the pillar portion 44 at the upper position of the bottom wall portion 51.

A communication space 541 is formed between an outer side of the baffle plate 54 and an inner side of the surrounding wall portion 55 in the cover portion 5 at the position offset from the top of the communication hole 52B in axial direction.

More specifically, between the baffle plate 54 and the pillar portion 44 is blocked, and a communication space 541 is disposed between an outer surface of the baffle plate 54 and an inner surface of the cover portion 5.

In addition, the infiltration of the water into the plug hole 81 may be prevented more effectively by moving formed portions of the communication hole 52B and the communication space 541 in a horizontal direction.

Figure 18:
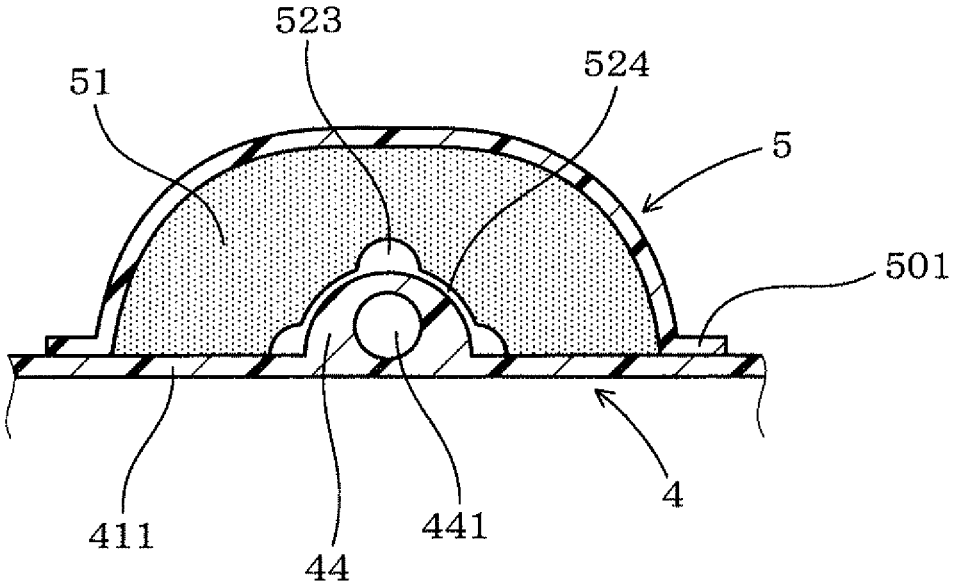
FIG. 18 is a section view showing a vicinity of the cover portion seen from the bottom in the second embodiment.

Moreover, as shown in FIG. 18, the communication hole 52B of the present embodiment is a space 52B between the inner side of the bottom wall portion 51 and the outer side of the pillar portion 44, and the space 52B may be formed so that its width is not uniform.

More specifically, the space 52B as the communication hole 52B may be formed by combining a broad gap portion 523 that has a broad width and a narrow gap portion 524 that has a narrower width than the broad gap portion 523.

The broad gap portion 523 may be formed so that its width is 1 mm or more compared with the width of the narrow gap portion.

Further, the water film may be effectively prevented being formed to the entire space 52B by making the surface tension different with the water that adheres to the broad gap portion 523 and the narrow gap portion 524.

Moreover, the drainage effect of the water collected in the water collecting chamber 50 may be improved.

Figure 20:
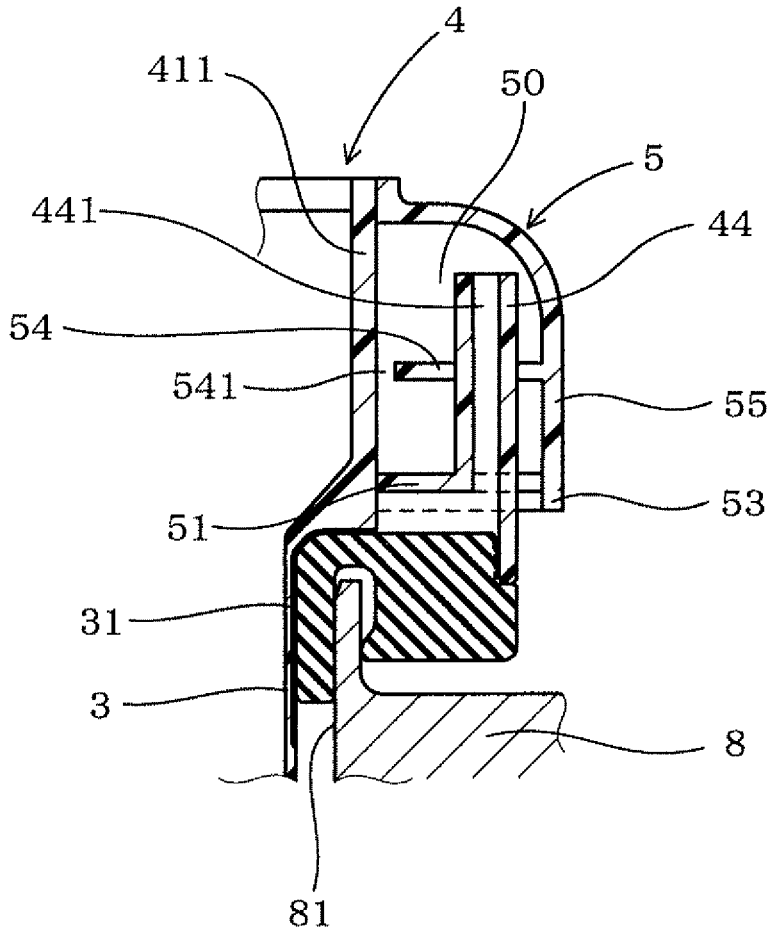
FIG. 20 is a sectional view showing a modification of a pillar portion in the second embodiment corresponding to the view taken along A-A line of FIG. 2.

Furthermore, the pillar portion 44 is not only formed adjacent to the sidewall portion 411 of the upper head portion 4 as shown in FIG. 16, but may be formed in a part near the central portion in the bottom wall portion 51 or a part near the main cover body 55 in the cover portion 5 as shown in FIG. 20.

In this case, the communication space 541 may be formed between the edges of the sidewall portion 411 and the baffle plate 54 of the upper head portion 4.

In the ignition coil 1 of the present embodiment, other compositions are similar to those of the above-mentioned first embodiment, while operations and effects similar to the above-mentioned first embodiment may be obtained.

What is claimed is:

1. An ignition coil for an internal combustion engine, the ignition coil comprising:

a cylinder portion disposed in a plug hole of the internal combustion engine by insertion;

an upper head portion connected to the cylinder portion and disposed outside of the plug hole;

a sealing member disposed outside the cylinder portion in a radial direction and under the upper head portion for preventing water from infiltrating into the plug hole from an opening of the plug hole;

a pillar portion on a side of the upper head portion, the pillar portion forming a part of a ventilation passage that communicates inside and outside of the plug hole via the sealing member; and a cover portion on the side of the upper head portion, the cover portion covering the pillar portion without blockading an upper opening of a ventilation opening of the pillar portion, the cover portion including:

a surrounding wall portion that covers an upper side and surroundings of the pillar portion;

a bottom wall portion that closes a lower side of the surrounding wall portion;

a water collecting chamber, which is a space formed by enclosing the surrounding wall portion and the bottom wall portion, that temporarily accommodates water infiltrated from outside of the upper head portion; and a communication hole formed in the bottom wall portion to drain the water accommodated in the water collecting chamber and to communicate between the water collecting chamber and the outside of the plug hole, wherein a bottom end of the surrounding wall portion includes a projected portion that projects from a lower edge surface of the bottom wall portion to define a lower edge surface of the surrounding wall portion, the lower edge surface of the bottom wall portion being located above the lower edge surface of the surrounding wall portion.

2. The ignition coil according to claim 1, wherein the communication hole is formed as a width-narrowing slit having an opening with a width that narrows from one end to another end.

3. The ignition coil according to claim 2, further comprising a drainer wall formed downwardly on an edge of the width-narrowing slit for draining the water collected in a part where the width of the opening is narrowed.

4. The ignition coil according to claim 1, further comprising:

a baffle plate disposed in the water collecting chamber between the communication hole and the upper opening, the baffle plate being configured to prevent the water infiltrated from the outside to infiltrate directly into the upper opening through the communication hole, and a communication space formed between an outer side of the baffle plate and an inner side of the surrounding wall portion at a position offset from a top of the communication hole in an axial direction.

5. The ignition coil according to claim 1, wherein the communication hole is formed as a space between an inner side of the bottom wall portion and an outer side of the pillar portion, and the space has a non-uniform width.

6. The ignition coil according to claim 1, wherein an upper surface of the bottom wall portion is sloped downwardly toward the communication hole.

7. The ignition coil according to claim 1, wherein the projected portion is disposed outward of the bottom wall portion in the radial direction.

* * * * *